US006315246B1

(12) United States Patent
Wu et al.

(10) Patent No.: US 6,315,246 B1
(45) Date of Patent: Nov. 13, 2001

(54) KITE

(76) Inventors: Pao-Chang Wu, 3F, 22, Lane 40, Second Pao An St., Su Lin Town, Taipei Shien (TW); Ping-Chao Lin, 9811 Talleyan Dr., Austin, TX (US) 78750

( * ) Notice: Subject to any disclaimer, the term of this patent is extended or adjusted under 35 U.S.C. 154(b) by 0 days.

(21) Appl. No.: 09/833,333

(22) Filed: Apr. 12, 2001

(51) Int. Cl.[7] ..... B64C 31/06

(52) U.S. Cl. ..... 244/153 R; 244/153 A; D21/445

(58) Field of Search ..... 244/153 R, 154, 244/153 A; D21/445, 446

(56) References Cited

U.S. PATENT DOCUMENTS 1,975,116 * 10/1934 McIntyre ..... 244/153 A
2,520,704 * 8/1950 Wisney ..... 244/153 R
5,098,039 * 3/1992 Linden, Jr. ..... 244/153 R
5,183,224 * 2/1993 Harburg ..... 244/153 R
5,352,144 * 10/1994 Kuhn ..... 244/153 R

* cited by examiner

*Primary Examiner*—J. Woodrow Eldred
(74) *Attorney, Agent, or Firm*—Alan Kamrath; Rider, Bennett, Egan & Arundel, LLP

(57) ABSTRACT

A kite has a cover sheet and a cross-shaped frame. The cover sheet has an oblong hole and four triangular corner bags. The cross-shaped frame has a spine, a two-way joint disposed on the spine, and two crosspieces connected to the two-way joint. Two rotating wheels are disposed on the spine. A plurality of rotating vanes engage with the rotating wheels. The spine is inserted in two of the triangular corner bags. Each of the crosspieces is inserted in the corresponding triangular corner bag. Two tail bands are connected to the cover sheet.

3 Claims, 4 Drawing Sheets

KITE

BACKGROUND OF THE INVENTION

The present invention relates to a kite. More particularly, the present invention relates to a kite which has a rotating vane.

A conventional kite has a spine adhered on a cover sheet. It is cumbersome to adhere the spine and the cover sheet together.

SUMMARY OF THE INVENTION

An object of the present invention is to provide a kite which has a rotating vane to be rotated by a wind.

Another object of the present invention is to provide a kite which is easily assembled.

Accordingly, a kite comprises a cover sheet and a cross-shaped frame. The cover sheet has an oblong hole and four triangular corner bags. The cross-shaped frame has a spine, a two-way joint disposed on the spine, and two crosspieces connected to the two-way joint. Two rotating wheels are disposed on the spine. A plurality of rotating vanes engage with the rotating wheels. The spine is inserted in two of the triangular corner bags. Each of the crosspieces is inserted in the corresponding triangular corner bag.

DETAILED DESCRIPTION OF THE INVENTION

Figure 1:
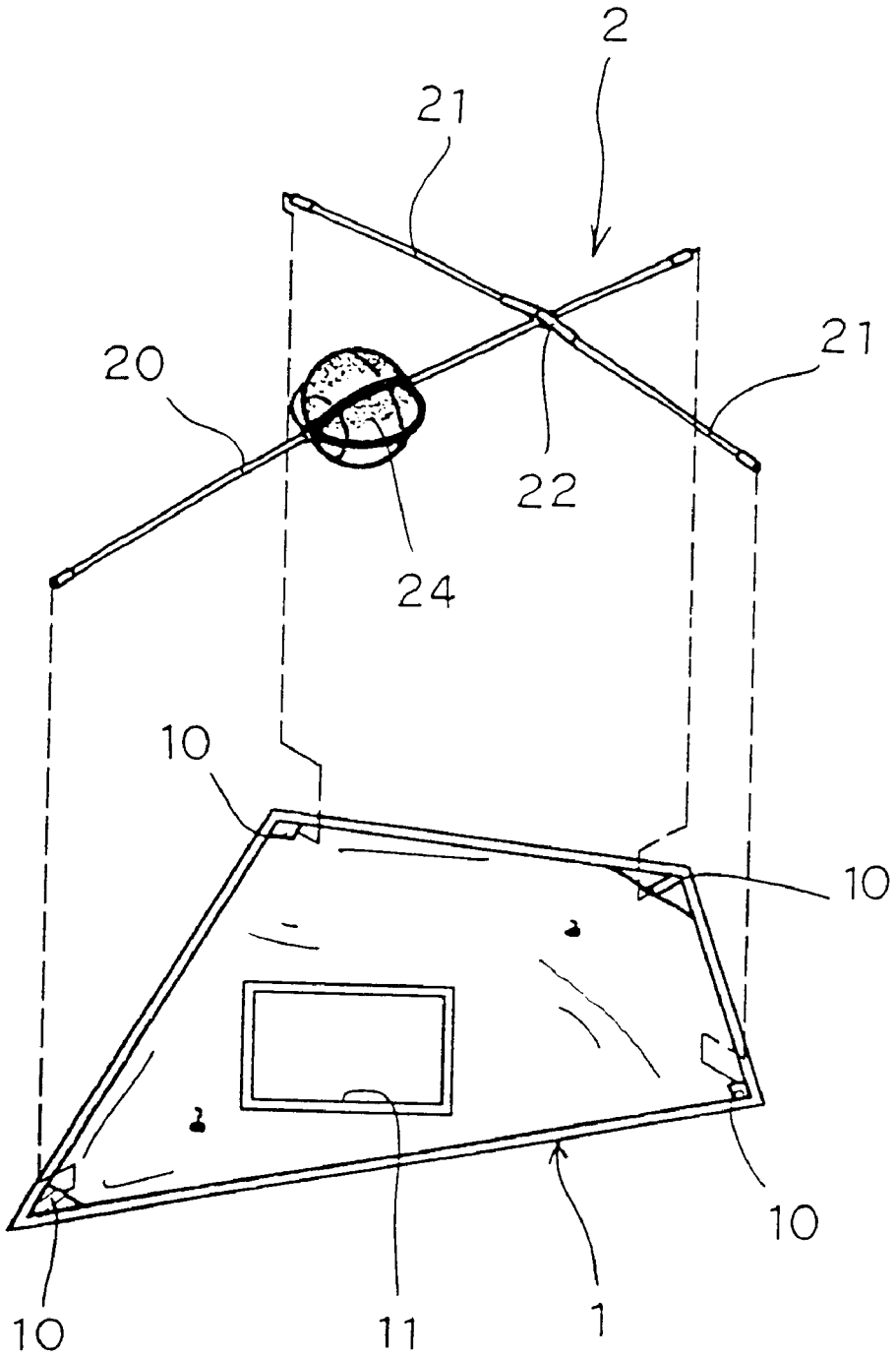
FIG. 1 is a perspective exploded view of a kite of a preferred embodiment in accordance with the present invention.
Figure 2:
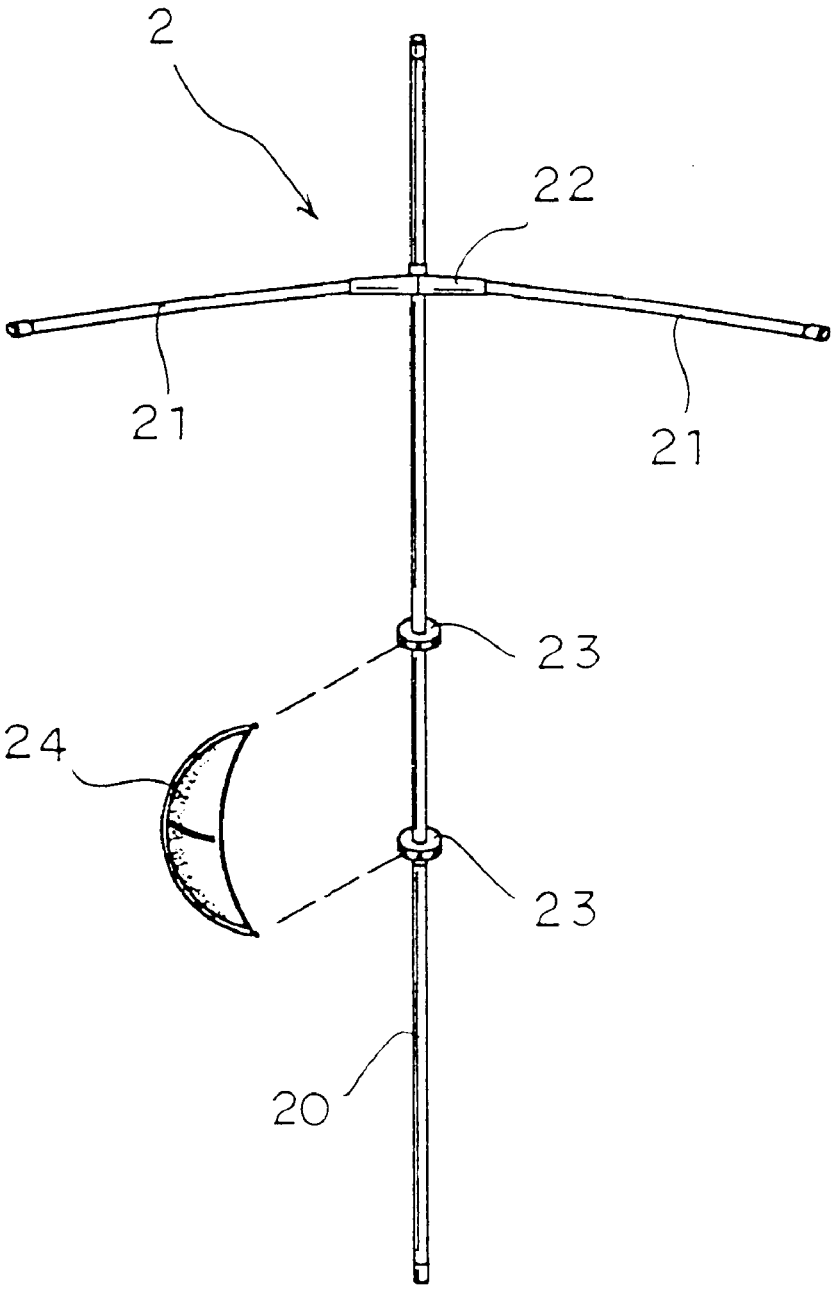
FIG. 2 is a perspective view of a cross-shaped frame of a preferred embodiment in accordance with the present invention.
Figure 3:
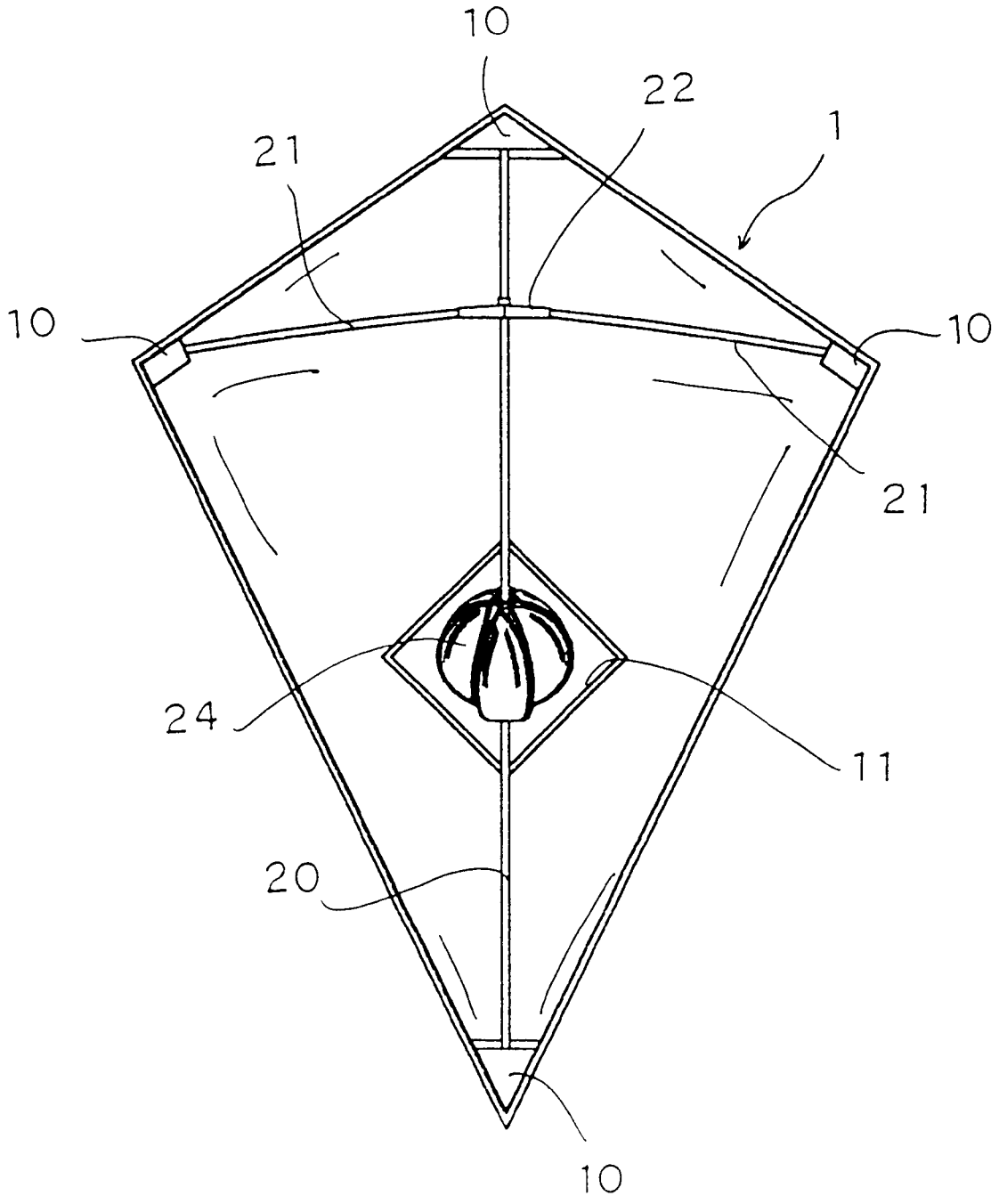
FIG. 3 is a perspective assembly view of a kite of a preferred embodiment in accordance with the present invention.
Figure 4:
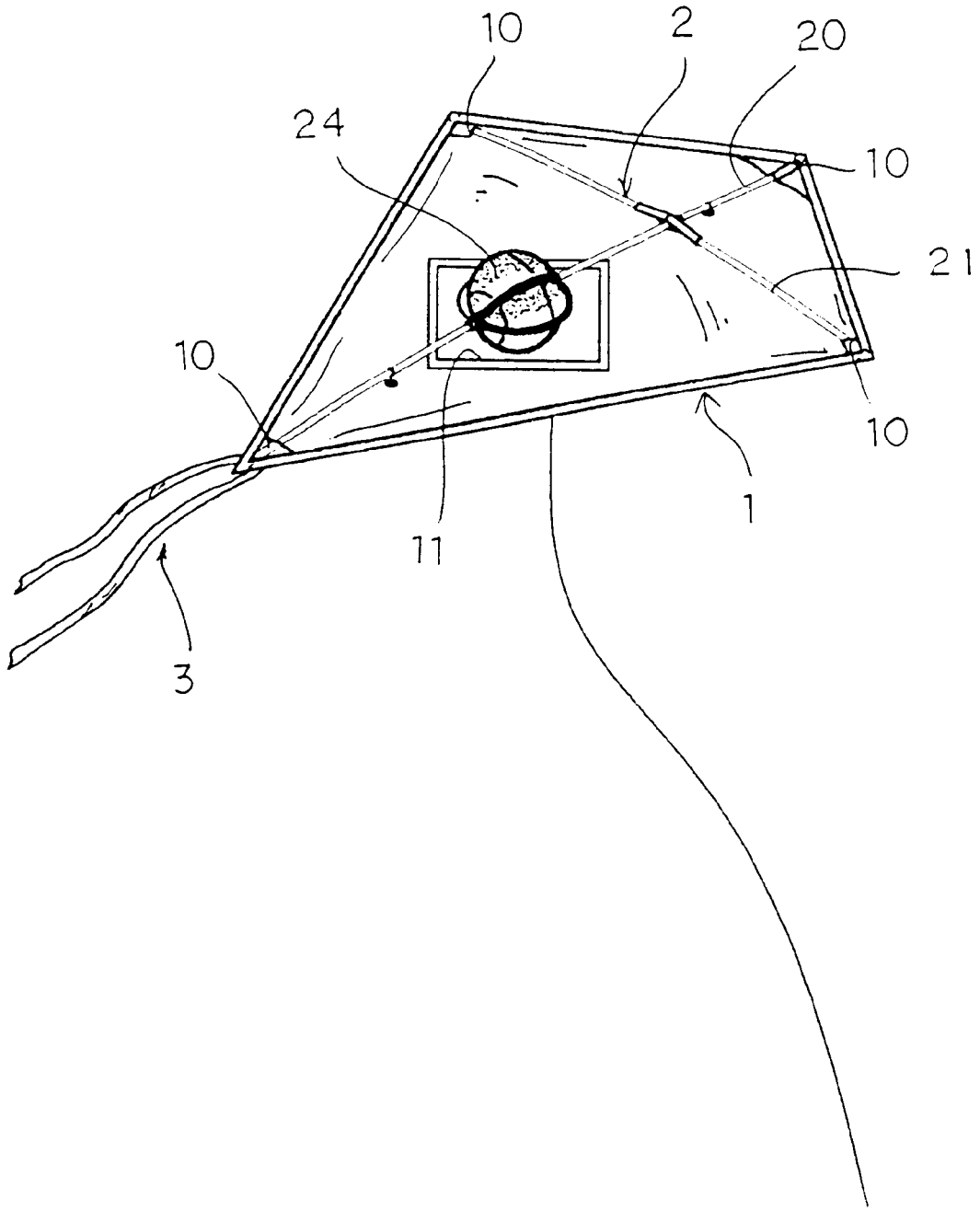
FIG. 4 is a schematic view illustrating an application of a kite of a preferred embodiment in accordance with the present invention.

Referring to FIGS. 1 to 4, a kite comprises a cover sheet 1 and a cross-shaped frame 2.

The cover sheet 1 has an oblong hole 11 and four triangular corner bags 10.

The cross-shaped frame 2 has a spine 20, a two-way joint 22 disposed on the spine 20, and two crosspieces 21 connected to the two-way joint 22.

Two rotating wheels 23 are disposed on the spine 20. A plurality of rotating vanes 24 engage with the rotating wheels 23.

The spine 20 is inserted in two of the triangular corner bags 10.

Each of the crosspieces 21 is inserted in the corresponding triangular corner bag 10.

The cover sheet 1 is made of fabric.

Two tail bands 3 are connected to the cover sheet 1. The tail bands 3 are made of fabrics also.

It is easy to assembly the kite of the present invention.

The present invention is not limited to the above embodiments but various modification thereof may be made. Furthermore, various changes in form and detail may be made without departing from the scope of the present invention.

We claim:

1. A kite comprises:

a cover sheet and a cross-shaped frame, the cover sheet having an oblong hole and four triangular corner bags, the cross-shaped frame having a spine, a two-way joint disposed on the spine, and two crosspieces connected to the two-way joint, two rotating wheels disposed on the spine, a plurality of rotating vanes engaging with the rotating wheels, the spine inserted in two of the triangular corner bags, and each of the crosspieces inserted in the corresponding triangular corner bag.

2. The kite as claimed in claim 1, wherein the cover sheet is made of fabric.

3. The kite as claimed in claim 1, wherein two tail bands are connected to the cover sheet.

* * * * *